US007649498B2

(12) United States Patent
Noro et al.

(10) Patent No.: US 7,649,498 B2
(45) Date of Patent: Jan. 19, 2010

(54) ANTENNA APPARATUS

(75) Inventors: Junichi Noro, Akita (JP); Kyuichi Sato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 34 days.

(21) Appl. No.: 12/011,354

(22) Filed: Jan. 25, 2008

(65) Prior Publication Data

US 2008/0186238 A1 Aug. 7, 2008

(30) Foreign Application Priority Data

Feb. 1, 2007 (JP) ..... 2007-022925

(51) Int. Cl.
*H01Q 1/38* (2006.01)

(52) U.S. Cl. ..... 343/700 MS

(58) Field of Classification Search ..... 343/700 MS, 343/702, 866, 871
See application file for complete search history.

(56) References Cited

U.S. PATENT DOCUMENTS

| | | | | |
|---|---|---|---|---|
| 6,295,030 | B1 | 9/2001 | Kozakai et al. | |
| 6,456,249 | B1 | 9/2002 | Johnson et al. | |
| 6,759,990 | B2 * | 7/2004 | Rossman | 343/700 MS |
| 6,806,840 | B2 * | 10/2004 | Hung et al. | 343/752 |
| 6,883,227 | B2 * | 4/2005 | Lebaric et al. | 29/600 |
| 7,075,486 | B2 * | 7/2006 | Suzuki | 343/700 MS |
| 7,298,344 | B2 * | 11/2007 | Brown | 343/797 |
| 7,352,327 | B2 * | 4/2008 | Yeh et al. | 343/700 MS |
| 2002/0080078 | A1 | 6/2002 | Trumbull et al. | |
| 2003/0174092 | A1 | 9/2003 | Sullivan et al. | |
| 2005/0099340 | A1 * | 5/2005 | Suzuki | 343/700 MS |
| 2007/0188383 | A1 | 8/2007 | Onaka et al. | |

FOREIGN PATENT DOCUMENTS

| | | | |
|---|---|---|---|
| EP | 1 703 587 | A1 | 9/2006 |
| JP | 2001-339232 | A | 12/2001 |
| JP | 2001-339233 | A | 12/2001 |
| JP | 2001-339234 | A | 12/2001 |

OTHER PUBLICATIONS

An Extended European Search Report dated Apr. 14, 2008, issued in a counterpart European Application.

* cited by examiner

*Primary Examiner*—Huedung Mancuso
(74) *Attorney, Agent, or Firm*—Frishauf, Holtz, Goodman & Chick, P.C.

(57) ABSTRACT

Disclosed is an antenna apparatus including a dielectric substrate, an antenna element formed of a metallic plate which is disposed by having a predetermined space from the dielectric substrate, a plurality of leg pieces which extend toward the dielectric substrate from the antenna element, a chip capacitor which is electrically connected to the leg pieces and the dielectric substrate and an insert member made of resin which is inserted between the dielectric substrate and the antenna element.

5 Claims, 6 Drawing Sheets

ANTENNA APPARATUS

BACKGROUND OF THE INVENTION

1. Field of the Invention

The present invention relates to an antenna apparatus, particularly to a small size flat type antenna apparatus used for the Global Positioning System (GPS) antenna or the like.

2. Description of Related Art

With the recent development of small size communication devices (for example, the GPS type car navigation apparatus, the portable navigation apparatus, the satellite wave receiving device and the like) such as mobile communication devices, downsizing and technological advances regarding the antenna apparatus which are used in such devices are desired. In this regard, a flat type antenna apparatus (for example, the circular polarized patch antenna or the like) among antenna apparatuses is structurally thin and small, and has an advantage that the integration with the semiconductor circuit is relatively easy. Therefore, it is broadly applied as an antenna for small size communication devices.

For example, there is known an antenna apparatus which comprises a substrate formed with a high dielectric material such as ceramic, a radiating element provided on the surface of the substrate and a circuit substrate as a flat type antenna apparatus (for example, see JP2001-339232A, JP2001-339233A and JP2001-339234A). In the antenna apparatus which has the above described structure, the capacitance of the antenna can be assured by the high dielectric material. Therefore, the resonance frequency becomes low, and the radiation conductive plate can be downsized.

However, ceramic is heavy and expensive. A thin film of silver is generally used for the radiating element provided on the surface thereof, and the thin film of silver is also expensive. Further, equipments such as the calcinating equipment for ceramic, the printing equipment for the thin film of silver and the like are needed. Therefore, resultingly, there is a problem that the manufacture cost of the antenna apparatus becomes expensive when ceramic is mounted and when the thin film of silver is formed in the small size flat type antenna apparatus as described in JP2001-339232A.

Further, ceramic contributes to the downsizing of the antenna apparatus because ceramic has very high dielectric constant. However, the circumference of the pattern needs to be adjusted by cutting a slit in the pattern of the patch for each apparatus because the dielectric constant and the capacitance vary. There is also a problem that the manufacture cost of the antenna apparatus increases as a result because the variation control of the dielectric constant and the capacitance is not necessarily easy, and the extraction rate is low.

SUMMARY OF THE INVENTION

In view of the above problem, a main object of the present invention is to provide an antenna apparatus which is small and in which the manufacture cost is low, and which can assure a sufficient capacitance.

According to a first aspect of the present invention, there is provided an antenna apparatus comprising a dielectric substrate, an antenna element formed of a metallic plate which is disposed by having a predetermined space from the dielectric substrate, a plurality of leg pieces which extend toward the dielectric substrate from the antenna element, a chip capacitor which is electrically connected to the leg pieces and the dielectric substrate and an insert member made of resin which is inserted between the dielectric substrate and the antenna element.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 5 is a perspective view expressing a state where an antenna element is fixed to the dielectric substrate and the like.

DESCRIPTION OF THE PREFERRED EMBODIMENTS

Hereinafter, the embodiment of the antenna apparatus according to the present invention will be explained with reference to the drawings. However, the scope of the invention is not limited to the illustrated example.

Figure 1:
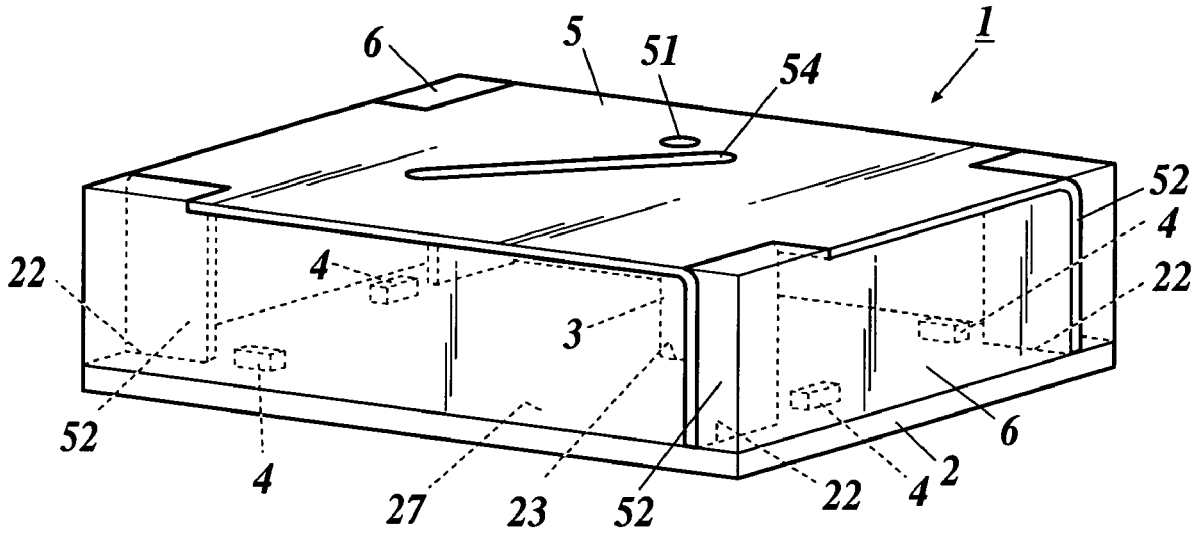
FIG. 1 is a perspective view showing an antenna apparatus according to the embodiment.
Figure 2:
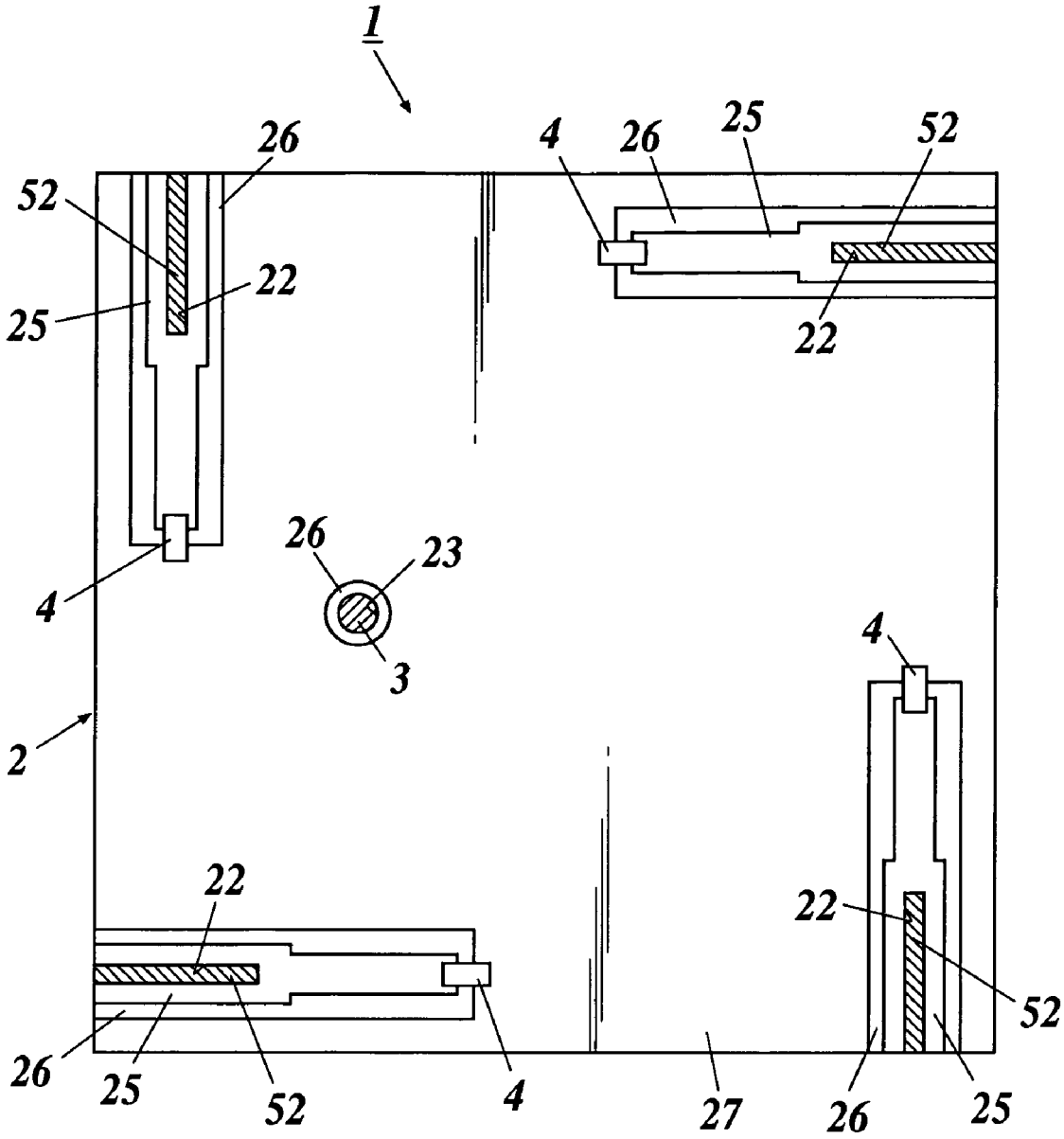
FIG. 2 is a bottom view showing the antenna apparatus shown in FIG. 1.
Figure 3:
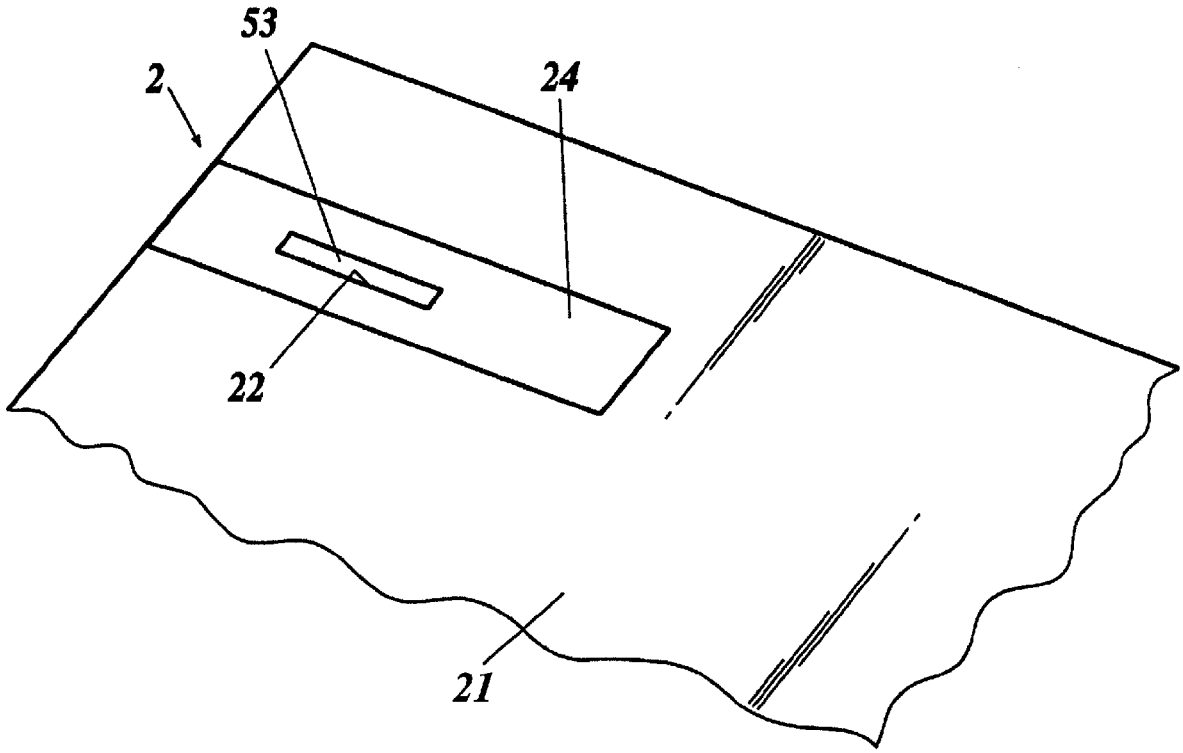
FIG. 3 is an enlarged view of a portion of a lower surface of a dielectric substrate of the antenna apparatus shown in FIG. 1.
Figure 4:
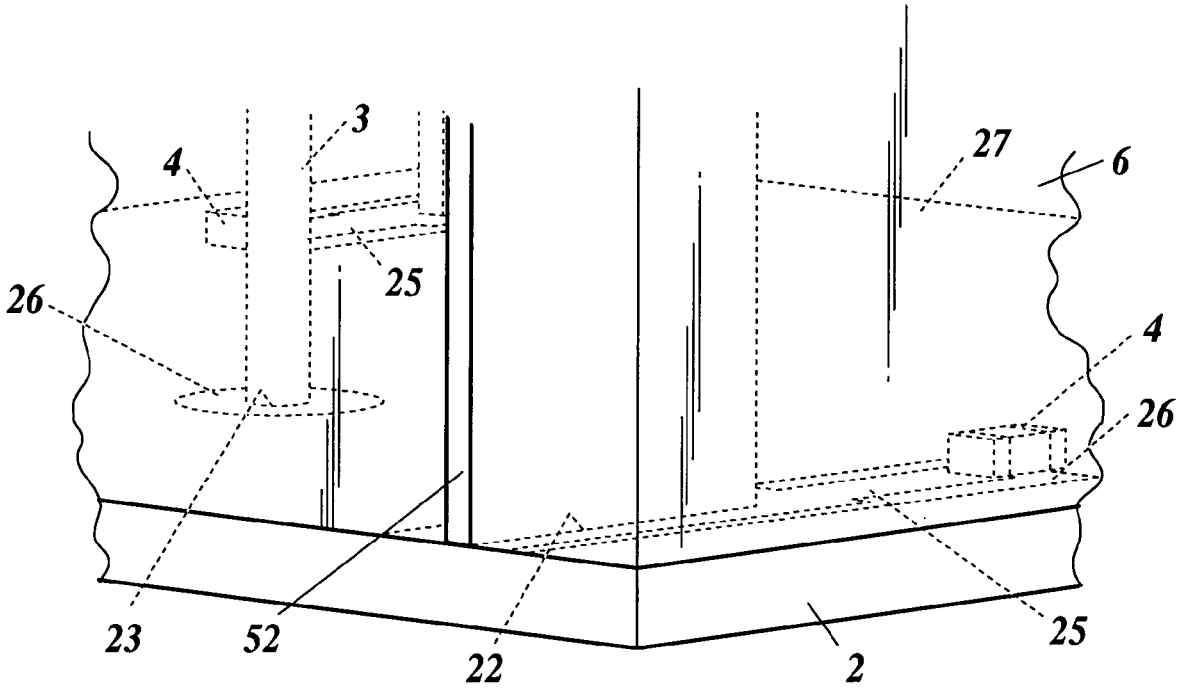
FIG. 4 is an enlarged view of a portion of an upper surface of the dielectric substrate of the antenna apparatus shown in FIG. 1.
Figure 5:
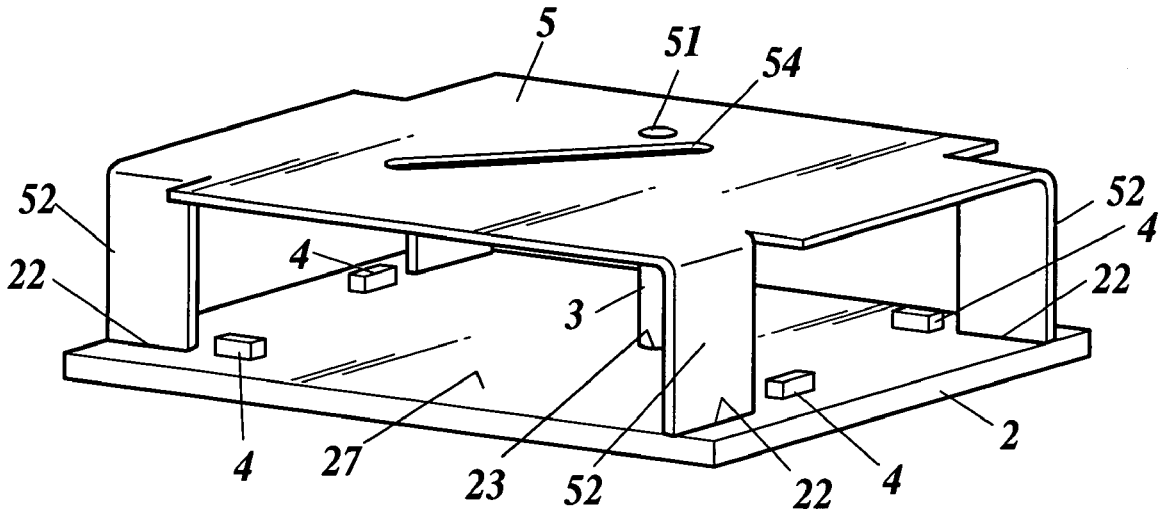
Figure 6A:
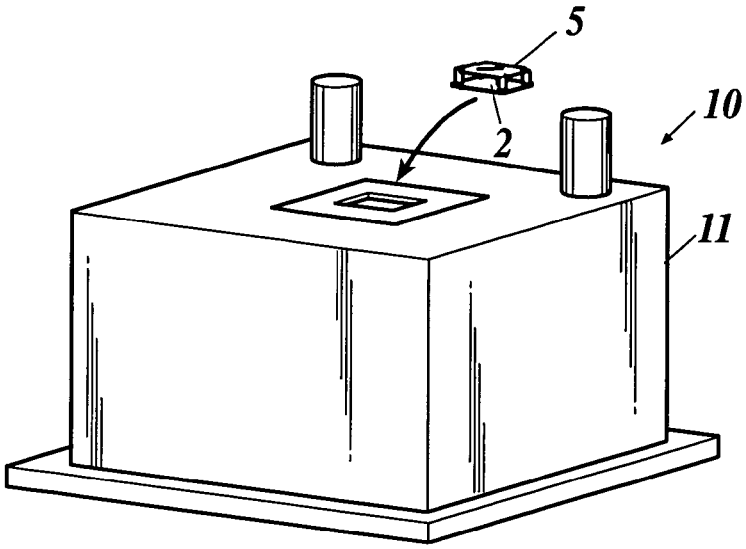
FIGS. 6A, 6B and 6C are schematic views for explaining the procedure of the insert molding.
Figure 6B:
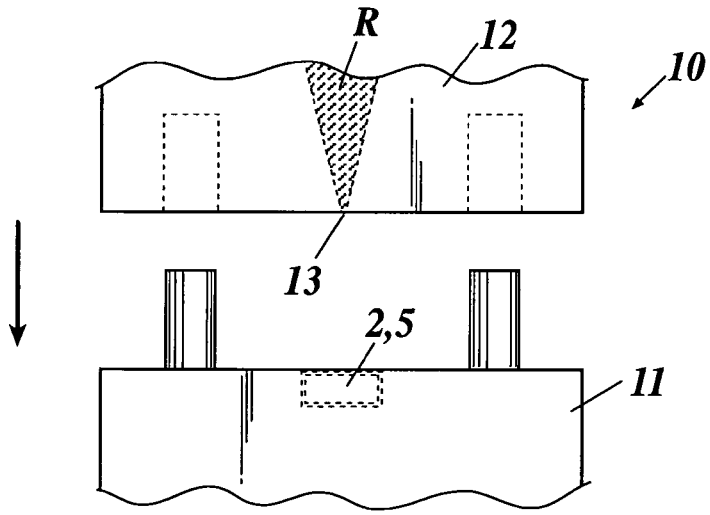
Figure 6C:
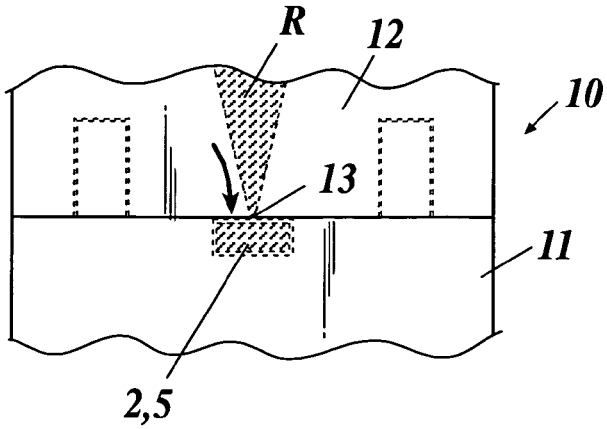

FIG. 1 is a perspective view of the antenna apparatus according to the embodiment. FIG. 2 is a diagram expressing the upper surface side of the dielectric substrate of the antenna apparatus shown in FIG. 1, and the insert member 6 is omitted. FIG. 3 is an enlarged view of a portion of a lower surface of the dielectric substrate of the antenna apparatus shown in FIG. 1, and FIG. 4 is an enlarged view of a portion of an upper surface of the dielectric substrate of the antenna apparatus shown in FIG. 1. Further, FIG. 5 is a perspective view expressing a state where an antenna element is fixed to the dielectric substrate, and FIGS. 6A, 6B and 6C are schematic views for explaining the procedure of the insert molding.

In the embodiment, the surface of the dielectric substrate, which faces the antenna element, is called the upper surface of the dielectric substrate, and the surface which is the opposite side of the upper surface of the dielectric substrate is called the lower surface of the dielectric substrate.

As shown in FIGS. 1 and 2, the antenna apparatus 1 comprises a dielectric substrate 2 having conductor layers 21, 27 which are a copper thin film or the like respectively at lower and upper surfaces of the dielectric substrate 2. The dielectric substrate 2 is formed in a rectangular shape, and four through holes 22 are respectively provided at each near-corner position of the dielectric substrate 2. Further, at the position slightly biased from the center of the dielectric substrate 2, the after mentioned insertion hole 23 in which the power supply pin 3 to be inserted is provided.

As shown in FIG. 3, on the lower surface of the dielectric substrate 2, insulating parts 24 are respectively provided at periphery of each through hole 22 and the insertion hole 23, and the through holes 22 are insulated from the conductor layer 21.

On the other hand, as shown in FIGS. 2 and 4, on the upper surface of the dielectric substrate 2, conduction parts 25 are respectively provided at periphery of each of the through holes 22 so as to encircle each through hole 22. At the periphery of the conduction parts 25 and at the periphery of the insertion hole 23, insulating parts 26 are respectively provided so as to encircle each conduction part 25 and the insertion hole 23. All the periphery area of the insulating parts 26 is covered with the conductor layer 27.

Moreover, on the upper surface of the dielectric substrate 2, the chip capacitors 4 are respectively provided by contacting with one end portion of each conduction part 25 as a lumped-parameter element. Each chip capacitor 4 is disposed so that one end thereof contacts with the conduction part 25 and the other end thereof contacts with the conductor layer 27, having the insulating part 26 in the middle.

For example, the chip capacitor 4 is a layered ceramic chip capacitor which is structured by sandwiching the conductive material such as ceramic or the like with metallic plates or the like. However, a capacitor is applicable as long as it is a small/light weight capacitor, and the structure is not specifically limited. Further, the chip capacitor 4 is to be disposed at the position in which one end of the chip capacitor 4 contacts with the conduction part 25 and the other end contacts with the conductor layer 27 by having the insulating part 26 in the middle, and the position is not limited to the position in the illustrated example.

In the embodiment, a case where the conduction parts 25 and the chip capacitors 4 are formed on the upper surface side of the dielectric substrate 2 is explained. However, they can be formed on the lower surface side of the dielectric substrate 2.

Moreover, regarding the insulating parts 24 which are provided on the lower surface of the dielectric substrate 2, the size of the insulating parts 24 in the longitudinal direction, which are respectively provided at the periphery of each of the through holes 22, is approximately same as the size of the conduction parts 25 which are provided on the upper surface of the dielectric substrate 2, and the insulating parts 24 which are respectively provided at the periphery of each of the through holes 22 face the conduction parts 25. In this way, the conduction parts 25 do not face the conductor layer 21 which is the lower surface.

In the insertion hole 23 of the dielectric substrate 2, the power supply pin 3 is inserted so as to penetrate the dielectric substrate 2. The lower end portion of the power supply pin 3, that is, the end portion of the power supply pin 3 which is protruded from the lower surface side of the dielectric substrate 2 can send the signal to the receiving circuit on the circuit substrate when the antenna apparatus is mounted on the circuit board of the electronic device such as a mobile terminal (omitted from the drawing) or the like. The circuit element of the noise amplifier (LNA) or the like is mounted to the mounted LNA substrate, and the signal can be sent to the receiving circuit via the coaxial cable.

At the upper direction of the upper surface side of the dielectric substrate 2, a tabular antenna element 5 which is disposed so as to be parallel with the dielectric substrate 2 by having a predetermined space from the dielectric substrate 2 is provided. For example, the antenna element 5 is structured by a metallic plate such as a copper plate or the like.

The power supply point 51 is provided at the position slightly biased from the center of the antenna element 5, and the upper end part of the power supply pin 3 which penetrates the dielectric substrate 2 is soldered to the power supply point 51. In the embodiment, a hole 54 is provided at approximately center of the metallic plate portion of the antenna element 5, and the hole 54 may be used for the inflow entrance of the resin at the time of the insert molding as described below.

At each near-corner position of the antenna element 5, a leg piece 52 which is made of metallic plate is respectively provided by hanging towards the dielectric substrate 2, and the leg pieces 52 are disposed so as to be approximately point symmetry with respect to the center of the antenna element 5. For example, the leg pieces 52 are formed integrally with the antenna element 5 by bending a portion of the antenna element 5. Here, the leg pieces 52 are to be disposed so as to be approximately point symmetry with respect to the center of the antenna element 5, and the number, the shape and the like of the leg pieces 52 are not limited to the example.

As shown in FIGS. 2 and 3, the end parts of the plurality of leg pieces 52 in the dielectric substrate 2 side are the fixation pieces 53 which are narrower than the leg pieces 52, and each fixation piece 53 is engagingly inserted in the through holes 22 which are respectively provided at each near-corner position of the dielectric substrate 2 and the antenna element 5 is temporarily fixed on the dielectric substrate 2. The fixation pieces 53 are to match with the surface of the dielectric substrate 2 in the lower surface side, or the fixation pieces 53 have a length that does not protrude from the lower surface side.

As described above, in the upper surface side of the dielectric substrate 2, the periphery of each through hole 22 is encircled by the conduction part 25, respectively, and the leg pieces 52 are fixed by soldering (omitted from the drawing) or the like. Further, each leg piece 52 is electrically connected with the conductor layer 27 of the dielectric substrate 2 via the above mentioned chip capacitor 4 which is connected with the conduction parts 25 by contacting with and being fixed to the conduction parts 25.

The insert member 6 made of resin is formed between the antenna element 5 and the dielectric substrate 2. In the embodiment, the insert member 6 is formed by the after mentioned insert molding in which the resin is filled between the antenna element 5 and the dielectric substrate 2 to form the insert member 6.

The resin used for the insert member 6 is arbitrarily selected from the view point of dielectric constant, fusing temperature, easiness of carrying out the insert molding and the like, and it is not limited to a specific resin. However, from the above view point, the ABS resin (acrylonitrile-butadiene-styrene resin), the liquid crystal polymer or the like are preferably used as material.

As for the method of insert molding of the insert member 6, the usual method can be used. Here, the insert molding of the insert member 6 will be specifically explained with an example.

As described above, first, the resin is injected to the bottom mold 11 of the mold 10 from the dielectric substrate 2 side as shown in FIG. 6A in a state where the antenna element 5 is fixed to the dielectric substrate 2 as shown in FIG. 5. Then, the mold 10 is closed by covering the bottom mold 11 with the top mold 12 from the upper direction as shown in FIG. 6B. Subsequently, the melted resin R in the top mold 12 is extracted via the bung hole 13 of the top mold 12 in a state where the mold 10 is closed as shown in FIG. 6C.

The extracted resin R is injected between the antenna element 5 and the dielectric substrate 2 from the hole 54 of the antenna element 5 shown in FIG. 5, and the resin enters in the gap of the antenna element 5 and the dielectric substrate 2 and eventually, the resin is filled between the antenna element 5 and the dielectric substrate 2 without a space. Then, although it is omitted from the drawing, the mold 10 is released, the antenna apparatus 1 (see FIG. 1) in which the filled resin is solidified to become the insert member 6 is taken out from the mold 10, and the insert molding is completed.

Next, the operation of the antenna apparatus 1 according to the embodiment will be explained.

The antenna apparatus 1 according to the embodiment is fixed by engageably inserting and temporarily fixing each fixation piece 53 provided at the end portion of a plurality of leg pieces 52 which is formed integrally with the antenna element 5 respectively in the through hole 22 provided on the dielectric substrate 2, and by fixing the leg pieces 52 to the conduction parts 25 which are provided on the upper surface of the dielectric substrate 2.

In such way, the leg pieces 52 are fixed to the dielectric substrate 2 without falling out, and each leg piece 52 becomes conductive to the conductor layer 27 of the dielectric substrate 2 via the chip capacitors 4 provided at the positions in which the chip capacitors 4 contact with both one end of each conduction part 25 and the conductor layer 27.

Moreover, the power supply pin 3 is inserted in the insertion hole 23 of the dielectric substrate 2, and the upper end of the power supply pin 3 is soldered to the power supply point 51 of the antenna element 5. In such way, the power supply pin 3 penetrates the dielectric substrate 2 without being conductive with the dielectric substrate 2, and is connected to the antenna element 5.

When a predetermined high frequency signal is supplied to the antenna element 5 via the power supply pin 3, the electric field is formed and the circular polarized wave is radiated from the antenna element 5. On the other hand, when the signal wave is received by the antenna element 5, the electric signal is output to the outside receiving circuit through the LNA circuit, the coaxial cable or the like.

Moreover, by filling the insert member 6 made of resin between the antenna element 5 and the dielectric substrate 2, a state where the high dielectric is inserted between the antenna element 5 and the dielectric substrate 2 is formed and a large capacitance can be assured between the antenna element 5 and the dielectric substrate 2.

Furthermore, when the insert member 6 is formed by the insert molding of resin as in the embodiment, resin is filled between the antenna element 5 and the dielectric substrate 2 without a space. Thereby, the insert member 6 adheres to the metallic plate antenna element 5, the upper surface of the dielectric substrate 2, the leg pieces 52 and the like, and is surely adhered without using an adhesive agent or the like.

By the insert member 6 being adhered to the antenna element 5, the dielectric substrate 2 and the like without a space, forming of the layer of air between the antenna element 5 and the insert member 6 and between the insert member 6 and the dielectric substrate 2 is blocked. Therefore, there is no variation of the dielectric constant of the insert member 6 due to the forming of the layer of air, and the variation of the dielectric constant of the insert member 6 and the variation of the capacitance of each product according to the variation of the dielectric constant are suppressed.

More capacitance is assured between the antenna element 5 and the dielectric substrate 2 because the leg pieces 52 of the antenna element 5 and the conductor layer 27 of the dielectric substrate 2 are conducted via the chip capacitor 4. The capacitance between the antenna element 5 and the dielectric substrate 2 can be adjusted easily by adjusting the capacity value of the chip capacitor 4.

As described above, according to the antenna apparatus 1 of the embodiment, the dielectric substrate 2, the antenna element 5 and the insert member 6 can be formed at low cost. Therefore, the manufacture cost of the antenna apparatus 1 can be suppressed at very low cost. Further, as described above, the resin, which constructs the insert member 6, itself is adhesive to the antenna element 5, the dielectric substrate 2 and the like. Therefore, there is no need to adhere the insert member 6 to the antenna element 5, the dielectric substrate 2 and the like by an adhesive agent or the like, and the apparatus can be manufactured at a low cost even more.

Moreover, by filling the insert member 6 made of resin between the dielectric substrate 2 and the antenna element 5, sufficiently large capacitance can be assured and the apparatus can be downsized more. Further, the capacitance becomes even larger by having the chip capacitor 4 provided between the dielectric substrate 2 and the antenna element 5. Therefore, the apparatus can be downsized more.

The layer of air which greatly influences the dielectric constant and the capacitance is not formed by the resin adhering to the antenna element 5 and the like as described above. Therefore, the variation of the dielectric constant of the insert member 6 or each product can be reduced to the level where it is not a practical problem.

Therefore, the variation control of the dielectric constant and the capacitance is very easy, and the capacitance between the antenna element 5 and the dielectric substrate 2 can be adjusted by adjusting the capacity value of the chip capacitor 4 as described above. However, actually, the variation can be suppressed to a level where the adjustment by the chip capacitor 4 is not needed.

Here, because the leg pieces 52 are disposed so as to be point symmetry with respect to the center of the antenna element 5, the performance of the antenna apparatus becomes stable. Further, because the chip capacitor 4 is respectively provided so as to correspond to each leg piece 52, the performance of the antenna apparatus becomes stable by the chip capacitors 4 being disposed at the symmetric positions.

Moreover, the proportion of downsizing of the antenna apparatus 1 can be adjusted by adjusting the capacity of the insert member 6 and the chip capacitor 4. Furthermore, it is needless to say that the present invention is not limited to the above described embodiment and can be arbitrarily changed.

According to a first aspect of the preferred embodiment of the present invention, there is provided an antenna apparatus comprising a dielectric substrate, an antenna element formed of a metallic plate which is disposed by having a predetermined space from the dielectric substrate, a plurality of leg pieces which extend toward the dielectric substrate from the antenna element, a chip capacitor which is electrically connected to the leg pieces and the dielectric substrate and an insert member made of resin which is inserted between the dielectric substrate and the antenna element.

In accordance with the first aspect of the preferred embodiment of the present invention, the dielectric substrate, the antenna element and the insert member can be formed at low cost. Therefore, the manufacture cost of the antenna apparatus can be suppressed at very low cost. Further, the resin, which constructs the insert member 6, itself, is adhesive to the antenna element, the dielectric substrate and the like. Therefore, there is no need to adhere the insert member to the antenna element, the dielectric substrate and the like by an adhesive agent or the like, and the apparatus can be manufactured at a low cost even more.

Moreover, by filling the insert member made of resin between the dielectric substrate and the antenna element, sufficiently large capacitance can be assured and the apparatus can be downsized more. Further, the capacitance becomes even larger by having the chip capacitor provided between the dielectric substrate and the antenna element. Therefore, the apparatus can be downsized more.

Preferably, the insert member is filled between the dielectric substrate and the metallic plate by an insert molding.

According to the preferred embodiment of the present invention, the product is manufactured efficiently by forming the insert member by filling the resin between the dielectric substrate and the antenna element by the insert molding. Furthermore, because the resin of the insert member adheres to the antenna element and the like in a state where the layer of air which greatly influences the dielectric constant and the capacitance is not formed, the variation of the capacitance of the insert member of each product can be reduced to the level where it is not a practical problem. Therefore, the effect of the preferred embodiment of the present invention can be brought out more efficiently and effectively.

Preferably, the insert member is made of an ABS resin or a crystal liquid polymer.

According to the preferred embodiment of the present invention, in addition to the above described effects, by forming the insert member with the ABS resin or the liquid polymer as material, the insert member can be formed easily at low cost. Also, the antenna apparatus which has almost no variation of the dielectric constant and the capacitance can be manufactured by filling the insert member between the antenna element and the dielectric substrate in good condition when the insert member is formed by the insert molding.

Preferably, the leg pieces are disposed so as to be point symmetry with respect to a center of the antenna element, and the chip capacitors are respectively provided so as to correspond to each leg piece.

According to the preferred embodiment of the present invention, in addition to the above described effects, the performance of the antenna apparatus becomes stable because the leg pieces are disposed so as to be point symmetrical with respect to the center of the antenna element. Further, the chip capacitor is respectively provided so as to correspond to each leg piece. Therefore, the effect that the performance of the antenna apparatus becomes stable is succeeded by the chip capacitor being disposed at the symmetry positions.

Preferably, a conductor layer in which a circuit is formed and a conduction part which is insulated from the conductor layer are provided on the dielectric substrate, one end of each of the leg pieces contacts with the conduction part, and the chip capacitor is provided so as to contact both one end of the conduction part and the conductor layer.

According to the preferred embodiment of the present invention, because the leg pieces of the antenna element are electrically connected to the conductor layer of the dielectric substrate via the chip capacitor, the capacitance between the antenna element and the dielectric substrate can be made large, and the apparatus can be downsized more. Therefore, the effects of the invention described above are brought out more effectively.

Preferably, an insulating part is provided between the conduction part of the dielectric substrate and the conductor layer, and the conduction part is encircled by the insulating part.

According to the preferred embodiment of the present invention, in addition to the above described effects, because the conduction parts and the conductor layer of the dielectric substrate are separated by the insulating unit, the conduction parts and the conductor layer can be insulated surely.

The entire disclosure of Japanese Patent Application No. 2007-022925 filed on Feb. 1, 2007 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus, comprising:

a dielectric substrate;

an antenna element formed of a metallic plate which is disposed at a predetermined space from the dielectric substrate;

a plurality of leg pieces which extend toward the dielectric substrate from the antenna element;

a plurality of chip capacitors each of which is provided so as to correspond to a respective one of the leg pieces, and each of which is electrically connected to the corresponding respective one of the leg pieces and the dielectric substrate; and an insert member made of resin which is inserted between the dielectric substrate and the antenna element, wherein the plurality of chip capacitors are mounted on the dielectric substrate such that they are disposed between the antenna element and the dielectric substrate, and wherein the insert member is filled in the space between the dielectric substrate and the metallic plate of the antenna element by insert molding.

2. The antenna apparatus as claimed in claim 1, wherein the insert member is made of an ABS resin or a crystal liquid polymer.

3. The antenna apparatus as claimed in claim 1, wherein the leg pieces are disposed so as to be point symmetrical with respect to a center of the antenna element.

4. The antenna apparatus as claimed in claim 1, further comprising:

a conductor layer in which a circuit is formed and a conduction part which is insulated from the conductor layer, wherein the conductor layer and the conduction part are provided on the dielectric substrate, wherein one end of each of the leg pieces contacts with the conduction part, and wherein each chip capacitor is provided so as to contact both one end of the conduction part and the conductor layer.

5. The antenna apparatus as claimed in claim 4, further comprising:

an insulating part which is provided between the conduction part of the dielectric substrate and the conductor layer, wherein the conduction part is encircled by the insulating part.

* * * * *